US006827561B2

(12) United States Patent
Seo et al.

(10) Patent No.: US 6,827,561 B2
(45) Date of Patent: Dec. 7, 2004

(54) CYLINDER ASSEMBLY AND HERMETIC COMPRESSOR HAVING THE SAME

(75) Inventors: Seung-don Seo, Gwangju (KR); Yong-yeoun Kim, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 24 days.

(21) Appl. No.: 10/369,155

(22) Filed: Feb. 19, 2003

(65) Prior Publication Data

US 2003/0198565 A1 Oct. 23, 2003

(30) Foreign Application Priority Data

Apr. 22, 2002 (KR) ..... 10-2002-0021877

(51) Int. Cl.[7] ..... F04B 39/10
(52) U.S. Cl. ..... 417/571; 417/569
(58) Field of Search ..... 417/569, 902, 417/312, 313, 571; 181/403, 250, 272, 254, 255

(56) References Cited

U.S. PATENT DOCUMENTS 4,854,839 A * 8/1989 DiFlora ..... 417/571
5,542,824 A * 8/1996 Lee ..... 417/312
5,577,901 A * 11/1996 Yoon ..... 417/571

FOREIGN PATENT DOCUMENTS

JP 10196536 A * 7/1998 ..... F04B/39/00

* cited by examiner

*Primary Examiner*—Charles G. Freay
(74) *Attorney, Agent, or Firm*—Ladas & Parry LLP

(57) ABSTRACT

A hermetic compressor having a cylinder assembly comprising a casing into which refrigerant flows, a rotor rotatably inserted in a stator disposed inside the casing, crank shaft, connecting rod connected with the crank shaft, piston, and cylinder assembly comprising a cylinder block, a valve plate connected with one side of the cylinder block and having a suction port for sucking refrigerant into the cylinder and discharge port for discharging the compressed refrigerant from the cylinder in the cylinder block, a suction valve for selectively opening the suction port, discharge valve for selectively opening the discharge port, cylinder head having suction and discharge chambers, a refrigerant path formed at one side of the cylinder head for letting refrigerant flow into the suction chamber, and a groove removed from the refrigerant path formed on the valve plate for guiding refrigerant from inside the casing into the suction chamber.

4 Claims, 6 Drawing Sheets

CYLINDER ASSEMBLY AND HERMETIC COMPRESSOR HAVING THE SAME

BACKGROUND OF THE INVENTION

1. Field of the Invention

The present invention relates generally to a hermetic compressor, and more particularly, to a cylinder assembly having the structure improved for easy suction of refrigerant into a cylinder, and a hermetic compressor having the cylinder assembly.

2. Background of the Related Art

As is known to those skilled in the art, a conventional hermetic compressor comprises a casing 100, a drive unit 200 disposed inside the casing 100, a compression unit 300, and a cylinder assembly 400, as shown in FIG. 1.

The casing 100 is comprised of an upper casing 110 and a lower casing 120 attached to each other, as shown, and has an inlet tube 130 and a discharge tube 140. Lubricant is stored at the bottom of the lower casing 120 and refrigerant flows in through the inlet tube 130 to be charged inside the casing 100.

The drive unit 200 comprises a stator 210 fixed in the casing 100, a rotor 220 disposed inside the stator to rotate relative thereto, and a crank shaft 230 disposed to rotate together with the rotor 220.

The compression unit 300 comprises a connecting rod 310 connected with an eccentric portion 240 of the crank shaft 230 being capable of converting the rotary movement of the rotor 220 into linear reciprocation, and a piston 320 connected with one end of the connecting rod 310.

The cylinder assembly 400 shown in exploded detail in FIG. 2 comprises a cylinder block 420 defining a cylindrical volume or cylinder 410 in which the piston is inserted, a cylinder head 430 connected with the cylinder block 420 by bolts A for sealing the cylinder 410, and a valve plate 440 interposed between the cylinder block 420 and the cylinder head 430.

Referring now to both FIGS. 1 and 2, the cylinder head 430 has a wall 431 formed at an inner side. The wall 431 divides the inside of the cylinder head 430 into a suction chamber 432 and a discharge chamber 433. The cylinder head 430 has a refrigerant path 434 and refrigerant from a suction muffler 500 flows into the suction chamber 432 through the refrigerant path 434.

A gasket 450 is interposed between the cylinder head 430 and the valve plate 440 for sealing therebetween.

The valve plate 440 comprises a suction port 441 and a discharge port 442. The suction port 441 connects the suction chamber 432 and the cylinder 410, and the discharge port 442 connects the discharge chamber 433 and the cylinder 410.

The suction port 441 is opened and closed by a suction valve 471. The suction valve 471 is integrally formed with a suction valve sheet 470 interposed between the cylinder block 420 and the valve plate 440. A gasket 460 is interposed between the suction valve sheet 470 and the cylinder block 420 for sealing therebetween.

The discharge port 442 is opened or closed by the movement of a discharge valve 481. The discharge valve 481 together with a stopper 482 and a keeper 483 are disposed in a recess 480, which is formed in the valve plate 440.

As shown in FIG. 3, in the conventional cylinder assembly 400 structured as described above, the pressure of the cylinder 410 is lower than that of the suction chamber 432 when the piston 320 moves from the top dead end to the bottom dead end, and the suction valve 471 moves in accordance with the pressure difference and thereby opens the suction port 441. Then, the refrigerant in the casing 100 flows into a suction muffler 500 (FIG. 1), and the refrigerant of the suction muffler 500 is sucked inside the cylinder 410 through the suction port 441 after passing the suction chamber 432.

However, in the case of a conventional cylinder assembly as described above, refrigerant is not easily sucked into the cylinder 410 because only the refrigerant inside the suction muffler 500 is sucked through the refrigerant path 434 at the time of the suction stroke of the piston 320.

In addition, since there is a large gap in pressure between the cylinder 410 and the suction chamber 432, the parts comprising the compressor are likely to undergo stress and the strength and starting efficiency of the compressor decrease.

SUMMARY OF THE INVENTION

An object of the invention is to solve at least the above problems and/or disadvantages and to provide at least the advantages described hereinafter.

Accordingly, one object of the present invention is to solve the foregoing problems by providing a cylinder assembly having improved strength and starting efficiency and a hermetic compressor employing the same by permitting the refrigerant to be more easily sucked into the cylinder.

In order to achieve the above object of the present invention, the cylinder assembly comprises a cylinder block having a cylinder for compressing refrigerant, a valve plate contacted to one side of the cylinder block and having a suction port for sucking refrigerant into the cylinder, a suction valve for opening and closing the suction port, a cylinder head connected with the valve plate and having a suction chamber, a refrigerant path formed at one side of the cylinder head for letting refrigerant flow into the suction chamber, and a groove formed on the valve plate removed from the refrigerant path for guiding refrigerant into the suction chamber.

It is preferable that the groove extended from one edge of the valve plate to the suction chamber.

In addition, the hermetic compressor according to the present invention comprises a casing into which refrigerant can flow, a rotor rotatably inserted in a stator disposed inside the casing, a crank shaft rotated by the rotor, a connecting rod having one end connected with the crank shaft, a piston connected with another end of the connecting rod, and a cylinder assembly in which refrigerant is compressed by operation of the piston, and the cylinder assembly comprises a cylinder block having a cylinder for compressing refrigerant, a valve plate contacted to one side of the cylinder block and having a suction port for sucking refrigerant into the cylinder and a discharge port for discharging the compressed refrigerant from the cylinder, a suction valve for opening and closing the suction port, a discharge valve for opening and closing the discharge port, a cylinder head disposed at one side of the valve plate and having a suction chamber and a discharge chamber, a refrigerant path formed at one side of the cylinder head for letting refrigerant flow into the suction chamber, and a groove formed on the valve plate removed from the refrigerant path for guiding refrigerant inside the casing into the suction chamber.

Additional advantages, objects, and features of the invention will be set forth in part in the description which follows and in part will become apparent to those having ordinary skill in the art upon examination of the specification and drawings or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF THE PREFERRED EMBODIMENTS

Figure 1:
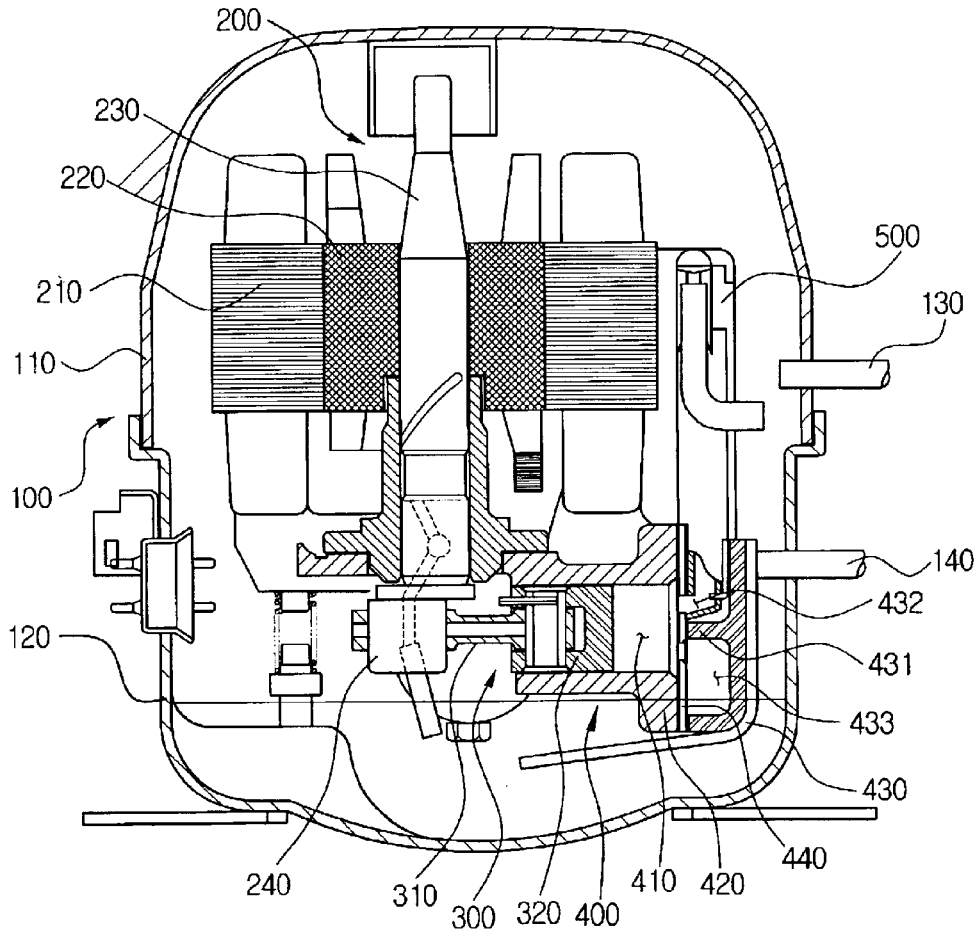
FIG. 1 (PRIOR ART)
FIG. 1 is a cross-sectional view showing a general conventional hermetic compressor.
Figure 2:
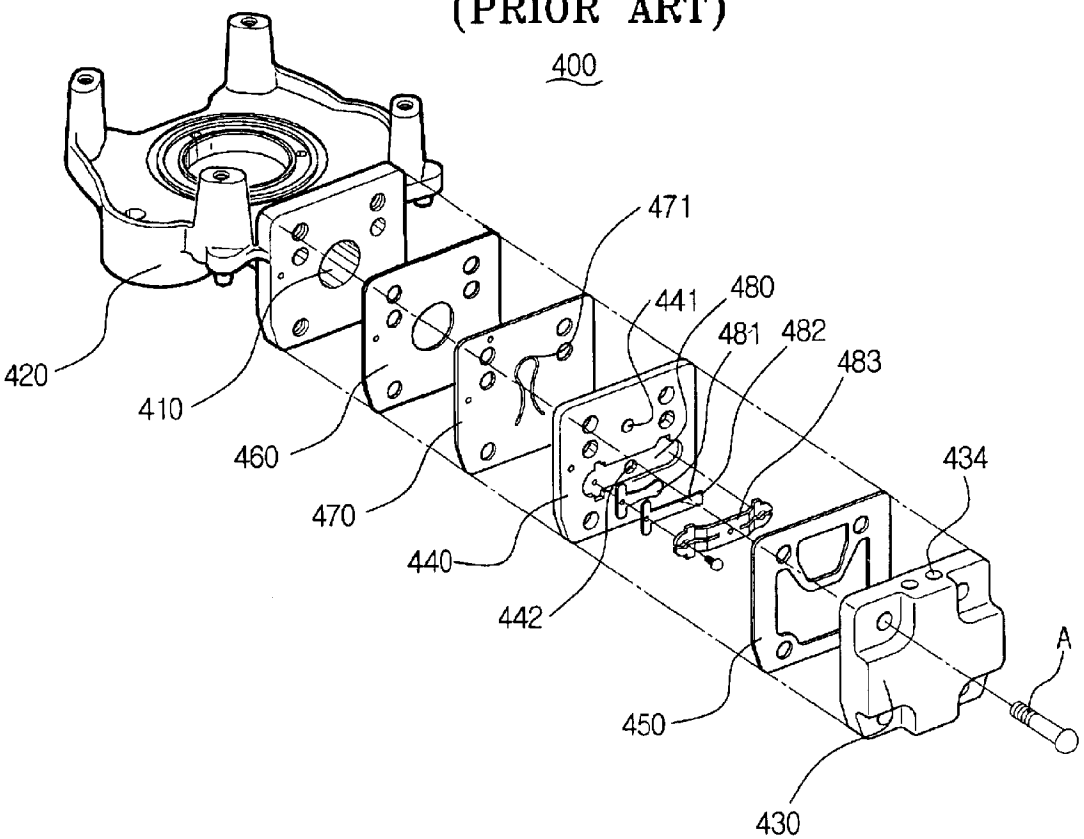
FIG.2 (PRIOR ART)
FIG. 2 is an exploded detail perspective view showing the conventional cylinder assembly shown in FIG. 1.
Figure 3:
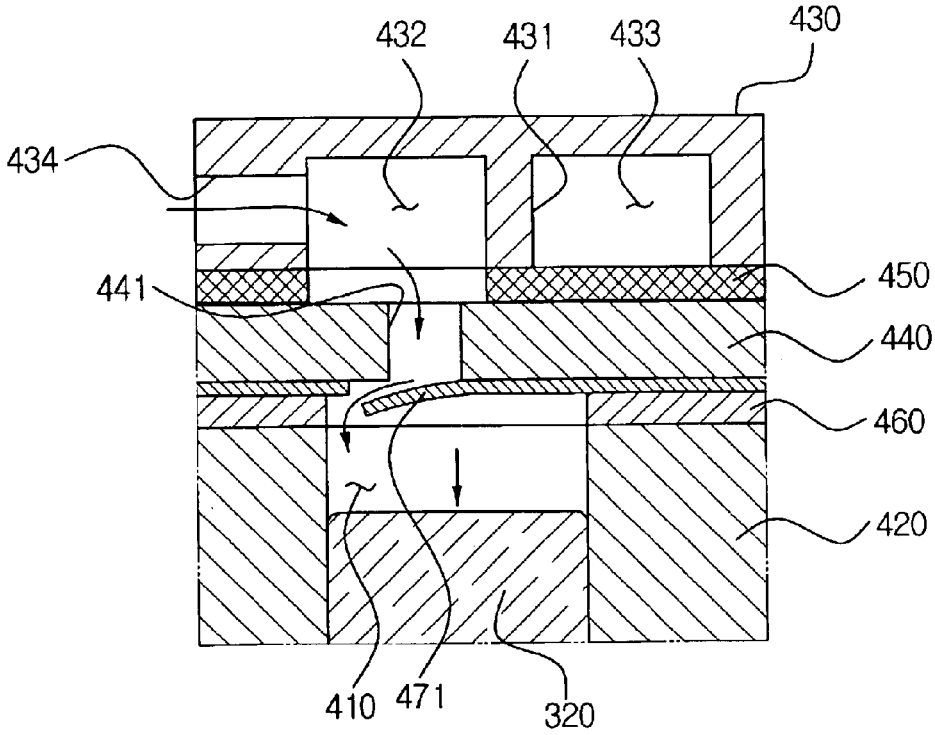
FIG.3 (PRIOR ART)
FIG. 3 is a cross-sectional view for describing the operation of the cylinder assembly shown in FIG. 2.

The following detailed description will present a cylinder assembly according to a preferred embodiment of the invention in reference to the accompanying drawings. In describing the embodiments, like elements will be given to the same reference numerals.

Figure 4:
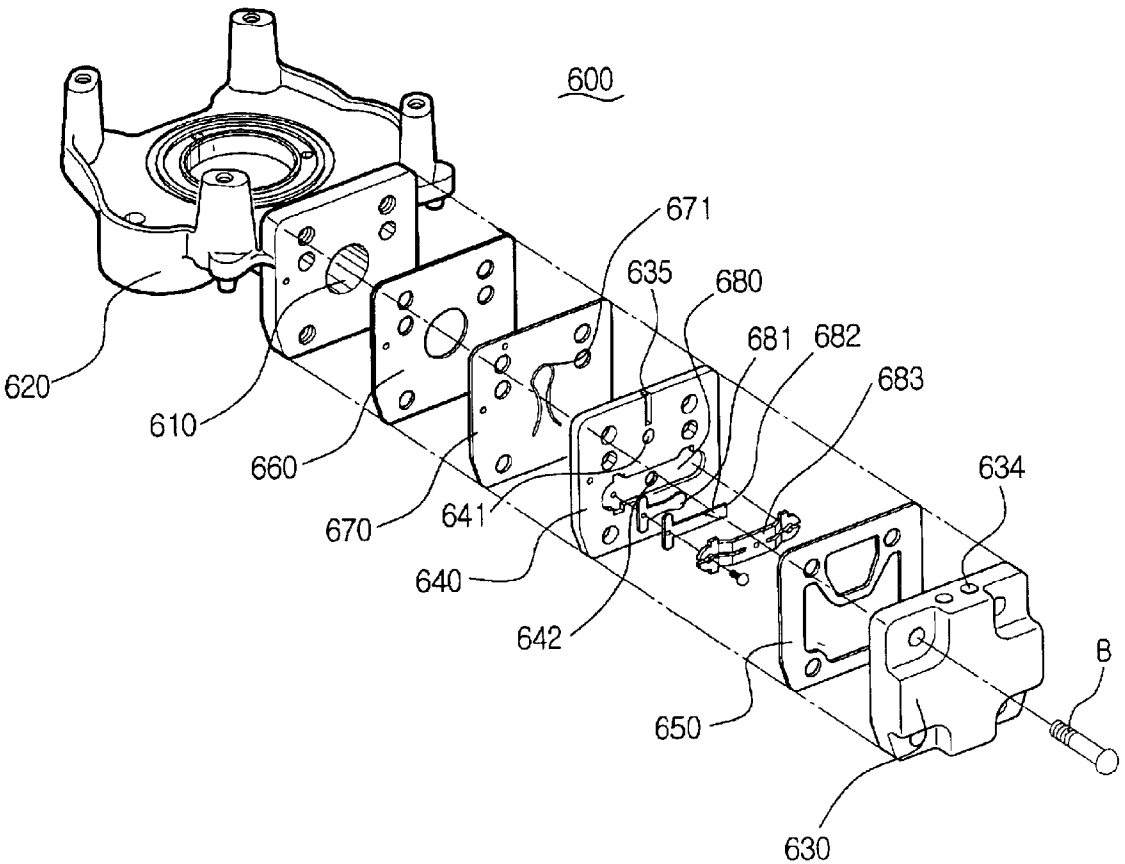
FIG. 4 is an exploded detail perspective view showing a cylinder assembly for a hermetic compressor according to a preferred embodiment of the present invention.

As shown in FIG. 4, the cylinder assembly 600 according to the present invention comprises a cylinder block 620, a cylinder head 630, and a valve plate 640.

The cylinder block 620 has a cylinder 610 for compressing refrigerant. The cylinder undergoes extreme pressure change as the suction and discharge of refrigerant are repeated.

The valve plate 640 disposed at the opening portion of the cylinder block 620 covers the cylinder 610, and comprises a suction port 641 and a discharge port 642. The suction port 641 is closed and opened by a suction valve 671 disposed between the valve plate and the cylinder block 620. The discharge port 642 is opened and closed by the discharge valve 681.

The suction valve 671 is integrally formed with a suction valve sheet 670 interposed between the valve plate 640 and cylinder block 620. A gasket 660 is interposed between the suction valve 670 and the cylinder block 620 for sealing therebetween.

The discharge valve 681, together with a stopper 682 and a keeper 683 for limiting the opening height, are disposed in a recess 680 formed in the valve plate 640. The discharge valve 681 can resiliently move as a result of the discharge pressure of refrigerant and may have various shapes.

Figure 6:
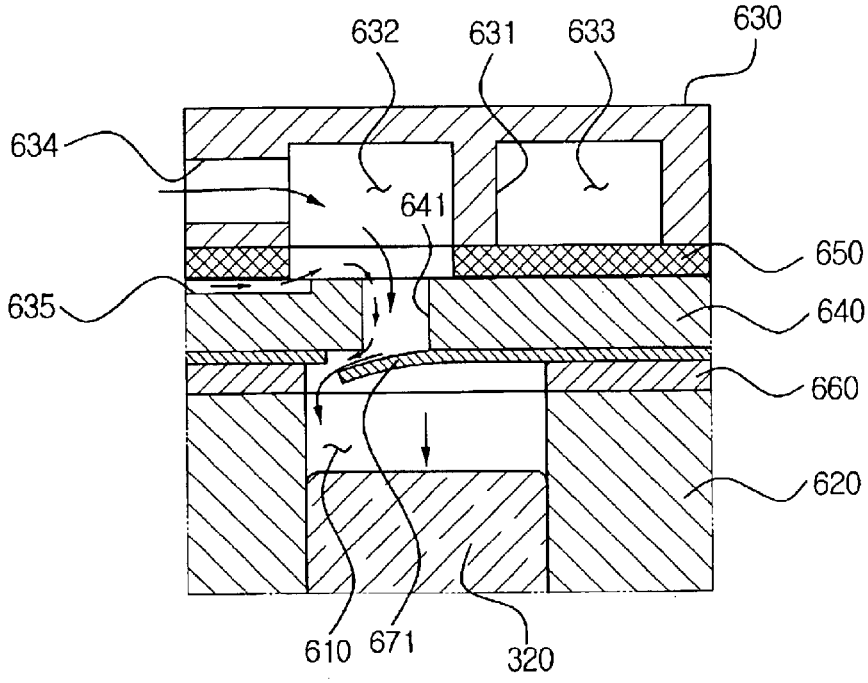
FIG. 6 is a cross-sectional view for describing the operation of the cylinder assembly of FIG. 4.

The cylinder head 630 is connected at one side of the cylinder block 620 to cover the valve plate 640 by a bolt B and comprises a suction chamber 632 and a discharge chamber 633 (FIG. 6). The suction chamber 632 is connected with the cylinder 610 through the suction port 641, and the discharge chamber 633 is connected with the cylinder 610 through the discharge port 642. A gasket 650 is interposed between the cylinder head 630 and the valve plate 640 for sealing the suction chamber 632 and the discharge chamber 633.

A refrigerant path 634 for guiding the refrigerant of a suction muffler 500 (FIG. 1) to flow into the suction chamber 632 is formed at one side of the cylinder head 630. The refrigerant flows into the suction chamber 632 through the refrigerant path 634 and is then sucked into the cylinder 610 through the suction port 641.

A groove 635 is formed at one edge of the valve plate 640. The refrigerant charged in the casing 100 flows into the suction chamber 632 through the groove 635 and then is sucked into the cylinder 610 through the suction port 641.

In the above-described embodiment, the groove 635 is shown to be connected from the edge of the valve plate 640 to the suction chamber 632 (FIG. 6). While it is not limited to that shape only, the groove 635 may be formed in various shapes in the cylinder assembly 600 for providing a flow path for the refrigerant charged inside the casing 100 to flow into the suction chamber 632 or to the suction port 641 of the cylinder assembly 600.

Figure 5A:
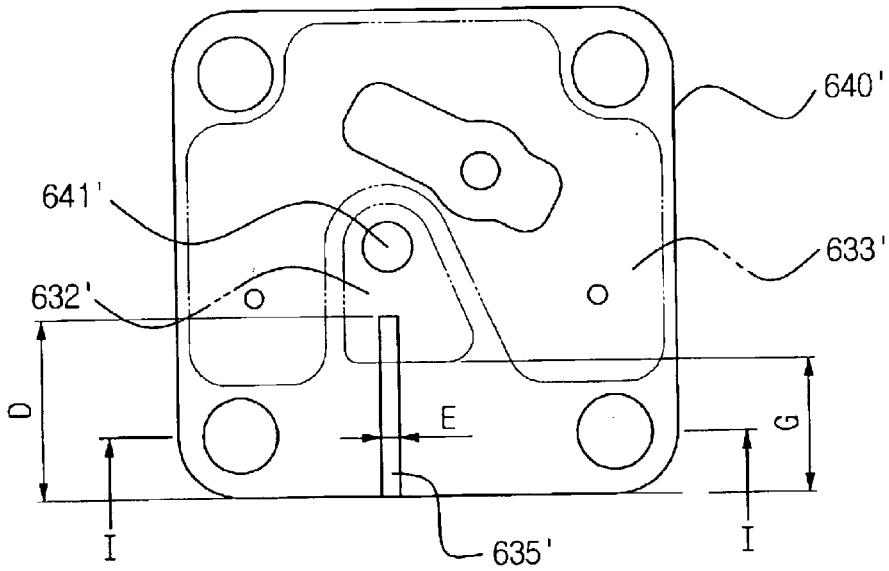
FIG. 5A is a plane view showing a part of a cylinder assembly according to another preferred embodiment of the present invention.
Figure 5B:
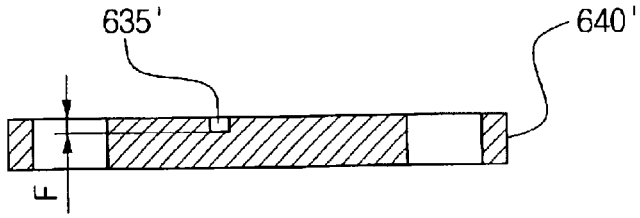
FIG. 5B is a cross-sectional view taken approximately along a line I—I of FIG. 5A.

In FIGS. 5A and 5B, another embodiment of a groove is shown. As shown in the drawings, the suction chamber 632' and the discharge chamber 633' are interposed between the valve plate 640' and the cylinder head (not shown). At one edge of the valve plate 640', the groove 635' is formed extending towards the suction chamber 632'. The groove 635' preferably has dimension values of 11.5 mm in length (D), 1.4 mm±0.7 mm in width (E), and 0.1 mm to 0.15 mm in depth (F). Here, the length of the groove 635' is longer than the length (G) 10 mm measured between one edge of the valve plate 640' and the suction chamber 632'. Therefore, the refrigerant that flows in through the groove 635' also flows into the suction chamber 632'.

Hereinafter, the refrigerant suction operation of a hermetic compressor employing the cylinder assembly according to the preferred embodiment of the present invention will be described.

When the compressor is driven, the piston 320 (FIG. 1) inside the cylinder 610 (FIGS. 4 and 6) moves from the top dead end to the bottom dead end thereby reducing the pressure in the cylinder 610. Accordingly, the suction valve 671 bends towards the cylinder 610 and the suction port 641 is opened. The refrigerant inside the suction muffler 500 (FIG. 1) then flows into the suction chamber 632 through the refrigerant path 634 and the refrigerant charged in the casing 100 flows into the suction chamber 632 through the groove 635. Then, the refrigerant inside the suction chamber 632 is sucked into the cylinder 610 through the suction port 641.

According to the structure of the present invention, refrigerant may be easily sucked into the cylinder 610 since the refrigerant flows into the suction chamber 632 not only through the refrigerant path 634 but also through the groove 635.

In addition, because some of the lubricant stored in the casing 100 is sucked into the cylinder 610 through the groove 635 together with the refrigerant, the piston 320 can be lubricated within the cylinder 610.

Furthermore, according to the present invention, the life of the compressor can be extended and the strength and starting efficiency can be improved without increasing the power generation of the drive unit 200.

While the invention has been shown and described with reference to certain preferred embodiments thereof, it will be understood by those skilled in the art that various changes in form and details may be made therein without departing from the spirit and scope of the invention as defined by the appended claims.

The foregoing embodiments and advantages are merely exemplary and are not to be construed as limiting the present invention. The present teaching can be readily applied to other types of apparatus. The description of the present invention is intended to be illustrative, and not to limit the scope of the claims. Many alternatives, modifications, and variations will become apparent to those skilled in the art from an understanding of this invention. In the claims, means-plus-function clauses are intended to cover the structures described herein as performing the recited function and not only structural equivalents but also equivalent structures.

What is claimed is:

1. A cylinder assembly comprising:

a cylinder block having a cylinder for compressing refrigerant;

a valve plate connected to one side of the cylinder block and having a suction port for sucking refrigerant into the cylinder;

a suction valve for opening and closing the suction port;

a cylinder head connected with the valve plate and having a suction chamber;

a refrigerant path formed at one side of the cylinder head for letting refrigerant flow into the suction chamber; and a groove formed on the valve plate removed from the refrigerant path for guiding refrigerant into the suction chamber.

2. The cylinder assembly according to claim 1 wherein the groove is extended from one edge of the valve plate to the suction chamber.

3. A hermetic compressor comprising:

a casing into which refrigerant can flow;

a rotor rotatably inserted in a stator disposed inside the casing;

a crank shaft rotated by the rotor;

a connecting rod having one end connected with the crank shaft;

a piston connected with another end of the connecting rod; and a cylinder assembly in which refrigerant is compressed by operation of the piston, wherein the cylinder assembly comprises;

a cylinder block having a cylinder for compressing refrigerant;

a valve plate connected to one side of the cylinder block and having a suction port for sucking refrigerant into the cylinder and a discharge port for discharging the compressed refrigerant from the cylinder;

a suction valve for opening and closing the suction port;

a discharge valve for opening and closing the discharge port;

a cylinder head disposed at one side of the valve plate and having a suction chamber and a discharge chamber;

a refrigerant path formed at one side of the cylinder head for letting refrigerant flow into the suction chamber; and a groove formed on the valve plate and removed from the refrigerant path for guiding refrigerant inside the casing into the suction chamber.

4. The hermetic compressor according to claim 3, wherein the groove is extended from one edge of the valve plate to the suction chamber.

* * * * *